US008184079B2

(12) United States Patent
Park et al.

(10) Patent No.: US 8,184,079 B2
(45) Date of Patent: May 22, 2012

(54) DISPLAY DEVICE HAVING REDUCED FLICKER

(75) Inventors: Young-Joo Park, Hwascong-si (KR); Jin-Oh Kwag, Suwon-si (KR); Hoe-Woo You, Seoul (KW); Jin-Hee Park, Seoul (KR)

(73) Assignee: Samsung Electronics Co., Ltd. (KR)

( * ) Notice: Subject to any disclaimer, the term of this patent is extended or adjusted under 35 U.S.C. 154(b) by 1339 days.

(21) Appl. No.: 11/698,364

(22) Filed: Jan. 25, 2007

(65) Prior Publication Data

US 2007/0171168 A1 Jul. 26, 2007

(30) Foreign Application Priority Data

Jan. 26, 2006 (KR) ..... 10-2006-0008146

(51) Int. Cl.
*G09G 3/36* (2006.01)

(52) U.S. Cl. ..... 345/92; 345/87

(58) Field of Classification Search ..... 345/38–39, 345/42, 46–48, 51–55, 83–84, 87–102, 204, 345/208–211
See application file for complete search history.

(56) References Cited

U.S. PATENT DOCUMENTS 5,587,722 A 12/1996 Suzuki et al.
5,929,847 A * 7/1999 Yanagi et al. ..... 345/204
6,002,384 A * 12/1999 Tamai et al. ..... 345/95
6,028,578 A 2/2000 Ota et al.
6,118,421 A * 9/2000 Kawaguchi et al. ..... 345/89
6,172,663 B1 * 1/2001 Okada et al. ..... 345/96
6,232,943 B1 5/2001 Tagawa et al.
6,509,895 B2 * 1/2003 Nishitani et al. ..... 345/211
6,864,872 B2 3/2005 Yang
6,867,760 B2 3/2005 Yanagi et al.
6,980,190 B2 * 12/2005 Ueda ..... 345/96
7,064,737 B2 * 6/2006 Lee et al. ..... 345/94
7,095,394 B2 * 8/2006 Hong ..... 345/89
7,106,291 B2 * 9/2006 Yoon ..... 345/98

(Continued)

FOREIGN PATENT DOCUMENTS

CN 1181146 5/1996

(Continued)

OTHER PUBLICATIONS

English Language Abstract, JP Patent First Publication No. 2005-189874, Jul. 14, 2005, 1 page.

(Continued)

*Primary Examiner* — Richard Hjerpe
*Assistant Examiner* — Mansour M Said
(74) *Attorney, Agent, or Firm* — Innovation Counsel LLP

(57) ABSTRACT

A driving apparatus for a display device and display device having the driving apparatus. The display device has a plurality of pixels each having a switching element. The driving apparatus includes a gate line connected to the switching element, a gate driver to apply a gate signal having first to third voltages to the gate line, a first voltage generator to generate the first and third voltages, and a second voltage generator to generate the second voltage. The first and second voltages turn on the switching element, and the third voltage turns off the switching element. The second voltage is less than the first voltage. Thus, since the gate driver includes the second voltage generator to generate the second voltage and a plurality of transistors, and generates a gate output having a step shape, a kickback voltage is reduced and flicker is prevented.

20 Claims, 4 Drawing Sheets

U.S. PATENT DOCUMENTS

| | | | | |
|---|---|---|---|---|
| 7,259,735 | B2 * | 8/2007 | Kasai | 345/77 |
| 7,379,004 | B2 * | 5/2008 | Hsu et al. | 341/144 |
| 2002/0008686 | A1 * | 1/2002 | Kumada et al. | 345/94 |
| 2005/0062706 | A1 | 3/2005 | Mizumaki | |
| 2006/0109232 | A1 * | 5/2006 | Kuo | 345/100 |

FOREIGN PATENT DOCUMENTS

| | | | |
|---|---|---|---|
| CN | 1652188 | | 8/2005 |
| CN | 1692398 | | 11/2005 |
| CN | 1714348 | | 12/2005 |
| JP | 01-219827 | | 9/1989 |
| JP | 09-101502 | A | 4/1997 |
| JP | 09-258174 | | 10/1997 |
| JP | 09-269477 | | 10/1997 |
| JP | 10-062755 | | 3/1998 |
| JP | 10-339862 | | 12/1998 |
| JP | 2000-137247 | A | 5/2000 |
| JP | 2003-084731 | | 3/2003 |
| JP | 2003-195833 | | 7/2003 |
| JP | 2004-212426 | A | 7/2004 |
| JP | 2005-189874 | | 7/2005 |
| JP | 2007-052291 | A | 3/2007 |
| KR | 1996-042509 | | 12/1996 |
| KR | 1020030034869 | | 5/2003 |

OTHER PUBLICATIONS

English Language Abstract, JP Patent First Publication No. 2003-195833, Jul. 9, 2003, 1 page.

English Language Abstract, KR Patent First Publication No. 1020030034869, May 9, 2003, 1 page.

English Language Abstract, JP Patent First Publication No. 2003-084731, Mar. 19, 2003, 1 page.

English Language Abstract, JP Patent First Publication No. 10-339862, Dec. 22, 1998, 1 page.

English Language Abstract, JP Patent First Publication No. 10-062755, Mar. 6, 1998, 1 page.

English Language Abstract, JP Patent First Publication No. 09-269477, Oct. 14, 1997, 1 page.

English Language Abstract, JP Patent First Publication No. 09-258174, Oct. 3, 1997, 1 page.

English Language Abstract, KR Patent First Publication No. 1996-042509, Dec. 21, 1996, 1 page.

English Language Abstract, JP Patent First Publication No. 01-219827, Sep. 1, 1989, 1 page.

* cited by examiner

DISPLAY DEVICE HAVING REDUCED FLICKER

CROSS-REFERENCE TO RELATED APPLICATION

This application claims priority to and the benefit of Korean Patent Application No. 10-2006-0008146 filed in the Korean Intellectual Property Office on Jan. 26, 2006, the entire contents of which are incorporated herein by reference.

FIELD OF THE INVENTION

The present invention relates to a display device having reduced flicker and a driving apparatus therefor.

DESCRIPTION OF THE RELATED ART

Display devices, for example liquid crystal displays (LCDs), include two display panels having pixel electrodes and a common electrode, respectively, and a liquid crystal layer disposed between the display panels and having dielectric anisotropy. The pixel electrodes are arranged in a matrix pattern and are connected to switching elements such as thin film transistors (TFTs), to sequentially receive a data voltage by columns. The common electrode is formed over the entire surface of one display panel and receives a common voltage. A pixel electrode, the common electrode, and the liquid crystal layer disposed between the pixel electrode and the common electrode form a liquid crystal capacitor in view of a circuit. The liquid crystal capacitor and the switching element connected thereto form a pixel unit.

Liquid crystal displays apply voltages to the two electrodes to form an electric field in the liquid crystal layer which provides an image by controlling the transmittance of light passing through the liquid crystal layer. If the electric field is applied to the liquid crystal layer in one direction for a long period of time, degradation occurs. In order to prevent such degradation, the polarity of the data voltage with respect to a common voltage is periodically reversed every frame, column, or pixel. In liquid crystal displays, flicker is caused by the kickback voltage that is proportional to the difference between the gate-on voltage and the gate-off voltage.

SUMMARY OF THE INVENTION

The present invention provides a display having reduced flicker using a driving apparatus that has less kickback voltage. According to one aspect of an exemplary embodiment of the present invention, a driving apparatus for a display device having a plurality of pixels, each having a switching element, includes a gate line connected to the switching element, a gate driver to apply a gate signal having first to third voltages to the gate line, a first voltage generator to generate the first and third voltages, and a second voltage generator to generate the second voltage. The first and second voltages turn on the switching element, and the third voltage turns off the switching element. The second voltage is less than the first voltage.

The gate driver includes first and second transistors to output the first and second voltages in response to the first control signal, and third and fourth transistors to output the second and third voltages in response to the second control signal. The first and fourth transistor may be N-type transistors, and the second and third transistors may be P-type transistors.

According to another aspect of an exemplary embodiment of the present invention, a display device includes a plurality of pixels each having a switching element, a gate line connected to the switching element, a gate driver to transfer a gate signal having the first to third voltages to the gate line, a first voltage generator to generate the first and third voltages, a second voltage generator to generate the second voltage, and a signal controller to generate a plurality of control signals and to control the gate driver.

BRIEF DESCRIPTION OF THE DRAWINGS

The foregoing and other features of the present invention may become more apparent from the ensuing description when read together with the accompanying drawing, in which.

DETAILED DESCRIPTION OF THE EMBODIMENTS

Figure 1:
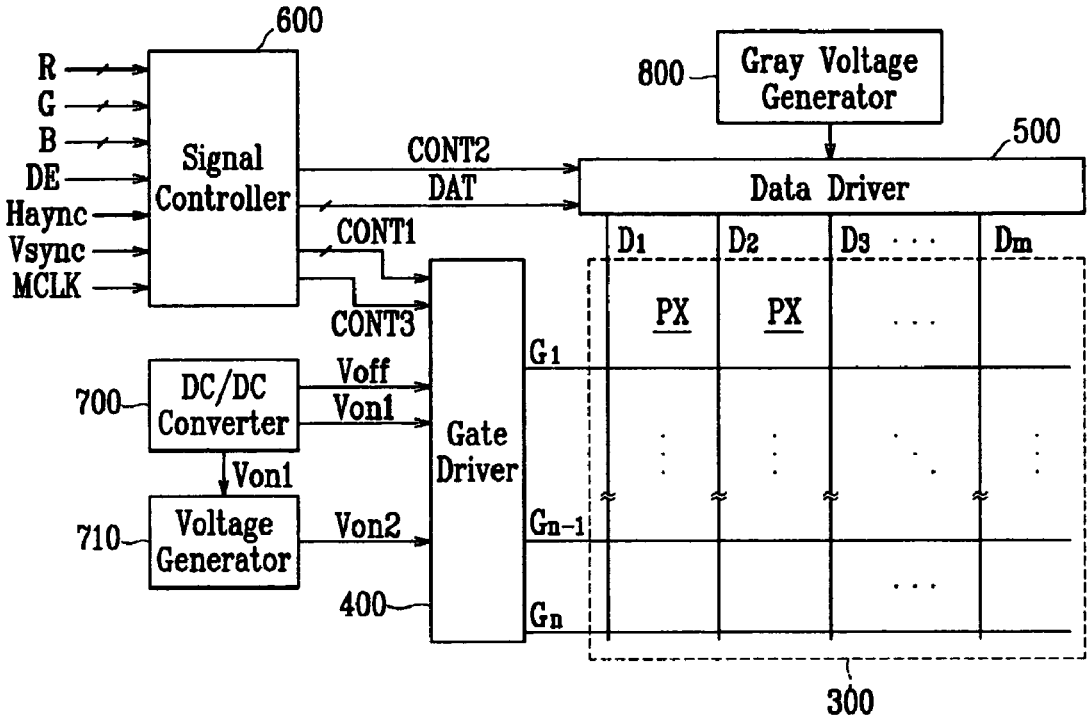
FIG. 1 is a block diagram of a liquid crystal display according to an exemplary embodiment of the present invention.

In the drawings, the thickness of layers, films, panels, regions, etc., are exaggerated for clarity. Like reference numerals designate like elements throughout the specification. It will be understood that when an element such as a layer, film, region, or substrate is referred to as being "on" another element, it can be directly on the other element or intervening elements may also be present. In contrast, when an element is referred to as being "directly on" another element, there are no intervening elements present.

Figure 2:
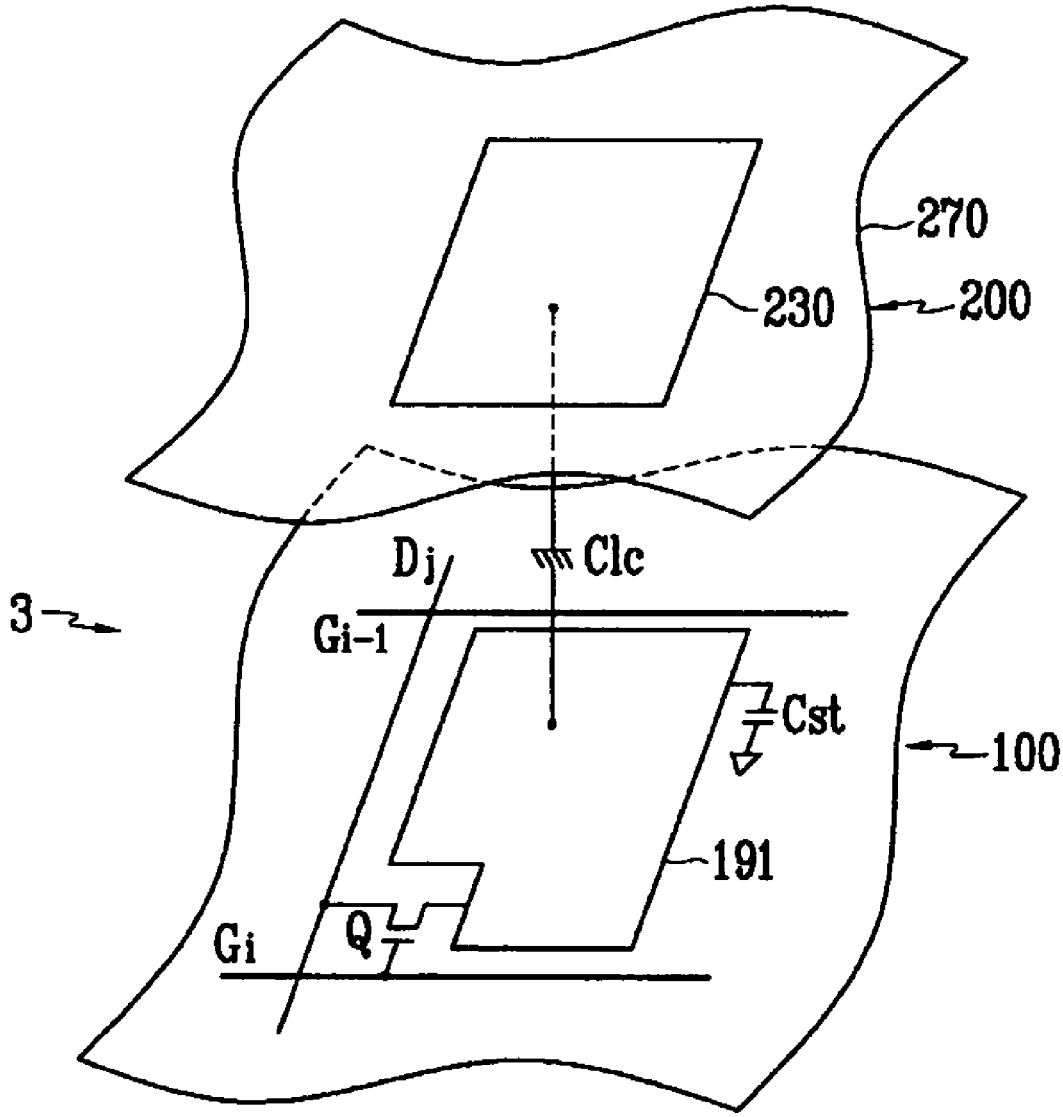
FIG. 2 is an equivalent circuit diagram of a pixel of a liquid crystal display of the present invention.

FIG. 1 is a block diagram of a liquid crystal display according to an exemplary embodiment of the present invention, and FIG. 2 is an equivalent circuit diagram of a pixel of a liquid crystal display according to an exemplary embodiment of the present invention. As shown in FIG. 1, a liquid crystal display according to an exemplary embodiment of the present invention includes a liquid crystal panel assembly 300, a gate driver 400 and data driver 500 connected to the liquid crystal panel assembly 300, a gray voltage generator 800 connected to the data driver 500, and a signal controller 600 to control the liquid crystal panel assembly 300, the gate driver 400, the data driver 500, and the gray voltage generator 800.

The liquid crystal panel assembly 300 includes a plurality of signal lines $G_1$-$G_n$ and $D_1$-$D_m$ and a plurality of pixels PX connected to the signal lines and arranged in a matrix. Referring to FIG. 2, the liquid crystal panel assembly 300 includes lower and upper panels 100 and 200 facing each other, and a liquid crystal layer 3 disposed between the panels 100 and 200.

Signal lines $G_1$-$G_n$ and $D_1$-$D_m$ include a plurality of gate lines $G_1$-$G_n$ to transfer gate signals ("scanning signals") and a plurality of data lines $D_1$-$D_m$ to transfer data signals. Gate lines $G_1$-$G_n$ extend in a row direction and are parallel to each other, while the data lines $D_1$-$D_m$ extend in a column direction and are parallel to each other.

Each of the pixels PX, for example a pixel PX connected to an i-th (i=1, 2, n) gate line $G_i$ and a j-th (j=1, 2, m) data line Dj, includes a switching element Q connected to a signal line $G_i$ or $D_j$, a liquid crystal capacitor Clc connected to the switching element Q, and a storage capacitor Cst connected to the switching element Q. The storage capacitor Cst may be omitted.

Switching element Q is a three-terminal element such as a thin film transistor, and is installed on the lower panel 100. The transistor includes a control terminal connected to the gate line $G_i$, an input terminal connected to the data line $D_j$, and an output terminal connected to the liquid crystal capacitor Clc and the storage capacitor Cst.

The liquid crystal capacitor Clc has two terminals, one being a pixel electrode 191 of the lower panel 100 and the other being a common electrode 270 of the upper panel 200. The liquid crystal layer 3 between the two electrodes 191 and 270 acts as a dielectric material. The pixel electrode 191 is connected to the switching element Q, and the common electrode 270 is formed over the entire upper panel 200 and receives a common voltage Vcom. Alternatively, the common electrode 270 may be installed on the lower panel 100, and in this case, at least one of the electrodes 191 and 270 may have a linear or plate shape.

Storage capacitor Cst, acting as an assistant of the liquid crystal capacitor Clc, is formed by the overlapping of additional signal lines (not shown) disposed on the lower panel 100 and the pixel electrode 191 with an insulator between them. The additional signal lines receive a predetermined voltage, such as the common voltage Vcom. Alternatively, the storage capacitor Cst may be formed by overlapping of the pixel electrode 191 and a gate line disposed on the pixel electrode 191 with an insulator between them.

For color representation, each pixel PX particularly represents one of the primary colors (spatial division). Alternatively each pixel PX may represent each of the primary colors during a period of time (temporal division). As a result, a desired color is represented by a spatial and temporal sum of the primary colors. The primary colors include red, green, and blue, for example. FIG. 2 shows, as an exemplary spatial division, a color filter 230 for representing one of the primary colors and that is disposed on an area of the upper panel 200 where each pixel PX corresponds to the pixel electrode 191. Alternatively, the color filter 230 may be formed above or below the pixel electrode 191 of the lower panel 100. The liquid crystal panel assembly 300 includes at least one polarizer (not shown) for polarizing light and that is attached to the outside of the assembly 300.

Still referring to FIG. 1, the gray voltage generator 800 generates two sets of gray voltages ("a set of reference gray voltages") related to the transmittance of the pixels PX. One set of gray voltages has a positive value with respect to the common voltage Vcom, and the other set has a negative value with respect to the common voltage Vcom.

A DC/DC converter 700 generates a gate-on voltage Von1 and a gate-off voltage Voff in response to a predetermined external voltage. Voltage generator 710 receives the gate-on voltage Von1 from the DC/DC converter 700 and generates a gate-on voltage Von2.

Gate driver 400 is connected to the gate lines $G_1$-$G_n$ and applies the gate signal formed by the combination of the gate-on voltages Von1 and Von2 and the gate-off voltage Voff from DC/DC converter 700 and voltage generator 710.

Data driver 500 is connected to data lines $D_1$-$D_m$, selects a gray voltage from gray voltage generator 800 and applies the selected gray voltage to the data lines. Gray voltage generator 800 may provide a predetermined number of the reference gray voltages, rather than all gray voltages in which case the data driver 500 divides the reference gray voltages to generate all grays and selects the data signal from among the generated gray voltages. Signal controller 600 controls the gate driver 400 or the data driver 500.

The driving apparatus 400, 500, 600, and 800 may be directly installed on the liquid crystal panel assembly 300 as one or more IC chips. Alternatively, the driving apparatus may be installed on a flexible printed circuit film (not shown), as a tape carrier package (TCP) attached to the liquid crystal panel assembly 300, or as an additional printed circuit board (PCB) (not shown). Alternatively, the driving apparatuses 400, 500, 600, and 800, along with the signal lines $G_1$-$G_n$ and $D_1$-$D_m$ and the thin film transistor switching element Q may be integrated on the liquid crystal panel assembly 300. As a further alternative, the driving apparatuses 400, 500, 600, and 800 may be integrated as a single chip, and in this case, at least one or at least one circuit forming them may be located outside of the single chip.

The operation of the liquid crystal display is illustrated in detail hereinafter. Signal controller 600 receives input image signals R, G, and B and input control signals for controlling the input image signals from an external graphic controller (not shown). The input control signals include, for example, a vertical synchronization signal Vsync, a horizontal synchronizing signal Hsync, a main clock signal MCLK, and a data enable signal DE.

Signal controller 600 processes the input image signals R, G, and B according to the operating requirements of liquid crystal panel assembly 300. Based on the input control signals and input image signals R, G, and B, controller 600 generates gate control signals CONT1 and CONT3 and data control signal CONT2. Controller 600 applies the gate control signals CONT1 and CONT3 to gate driver 400 and applies data control signal CONT2 and the processed image signal DAT to data driver 500.

Gate control signal CONT1 includes, for example, a scanning start signal STV for indicating the start of scanning and at least one clock signal for controlling the output period of the gate-on voltage Von or the output enable signal OE for limiting the time of the gate-on voltage Von2.

Gate control signal CONT3 is a switching control signal for controlling the switching element.

Data control signal CONT2 includes, for example, a horizontal synchronization start signal STH for indicating the start of transferring image data to the pixels PX of a single column [bundle], a load signal LOAD for loading data signals on the data lines $D_1$-$D_m$, or a data clock signal HCLK. Data control signal CONT2 may further include an inversion signal RVS for inverting the voltage polarity of the data signals with respect to the common voltage Vcom. Hereinafter, "the voltage polarity of the data signal with respect to the common voltage" is abbreviated to "the polarity of the data signal".

In response to data control signal CONT2 data driver 500 receives digital image signals DAT for the pixels PX of a single column [bundle], selects a gray voltage corresponding to each of the digital image signal s DAT, converts the digital image signals DAT into analog data signals, and applies the data signals to the corresponding data lines $D_1$-$D_m$.

In response to the gate control signals CONT1 and CONT3 from signal controller 600, gate driver 400 applies the gate-on voltages Von1 and Von2 to gate lines $G_1$-$G_n$, and turns on the switching elements Q connected to the gate lines. Then, the data signals applied to the data lines $D_1$-$D_m$ are applied to corresponding pixels PX through the turned-on switching elements Q.

The difference between the voltages of the data signals applied to the pixels PX and the common voltage Vcom is the charging voltage of the liquid crystal capacitor Clc, that is, the pixel voltage. Liquid crystal molecules change their arrangement according to the magnitude of the pixel voltage which changes the polarization of the light passing through the liquid crystal layer 3. Such polarization change is shown as the light transmittance by a polarizer attached to the display panel assembly 300.

Figure 5:
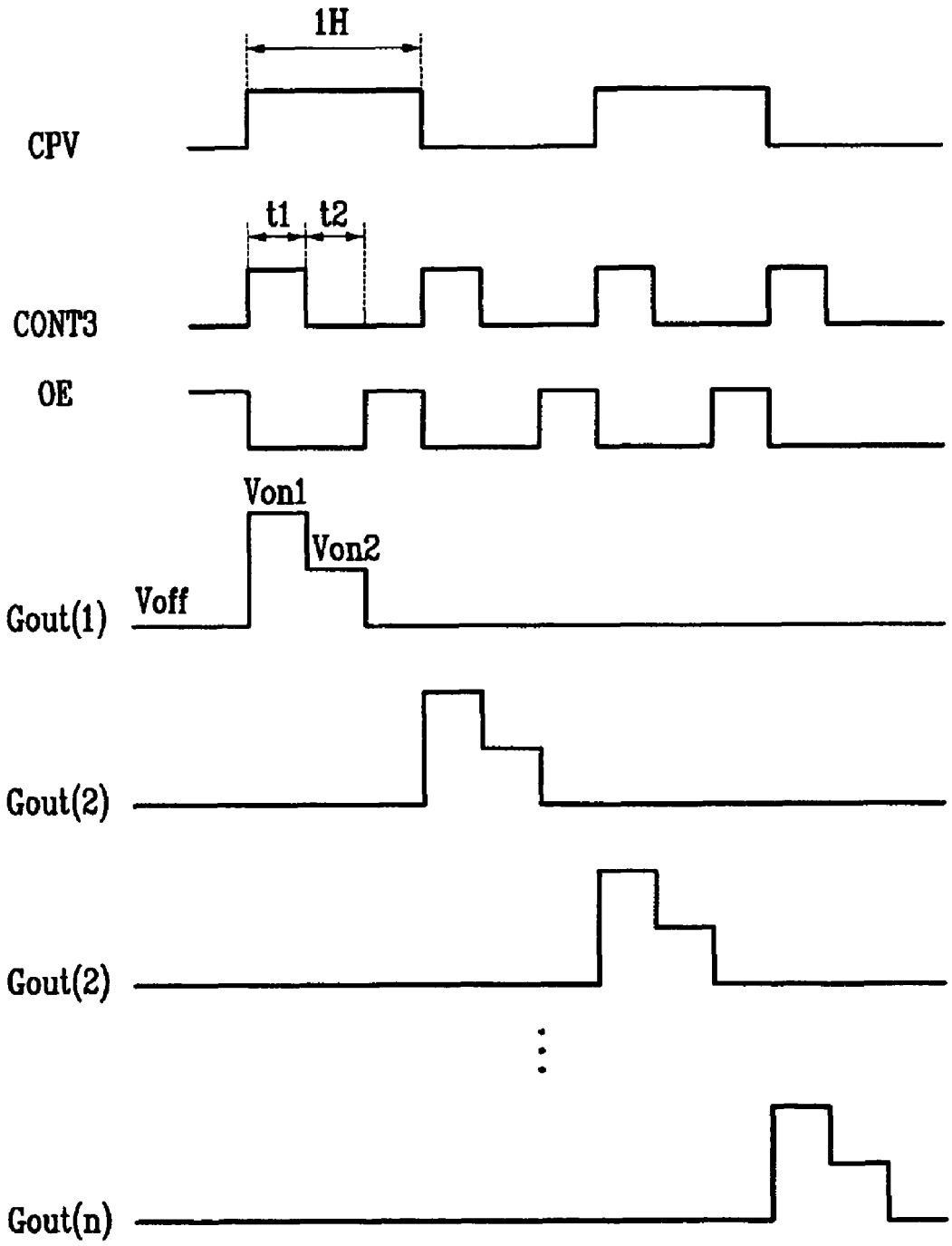
FIG. 5 is a signal waveform diagram of the gate driver of FIG. 4.

The unit time period of the horizontal scan, the so called "1 H", FIG. 5, is the period of the horizontal synchronizing signal Hsync and the data enable signal DE. By repeating the operation, the gate-on voltages Von1 and Von2 are sequentially applied to all gate lines $G_1$-$G_n$, and the data signals are applied to all pixels PX. As a result, a single frame image is displayed.

When one frame is finished, the next frame is started. The inversion signal RVS applied to the data driver 500 is controlled such that the polarity of the data signal applied to each pixel PX is opposite to the polarity of the data signal of a previous frame ("frame inversion"). Within a single frame, according to the characteristic of the inversion signal RVS, the polarity of the data signals along a single data line may be inverted (for example, row inversion or dot inversion), or the polarity of the data signals applied to a single pixel column may be different (for example, column inversion or dot inversion).

Figure 3:
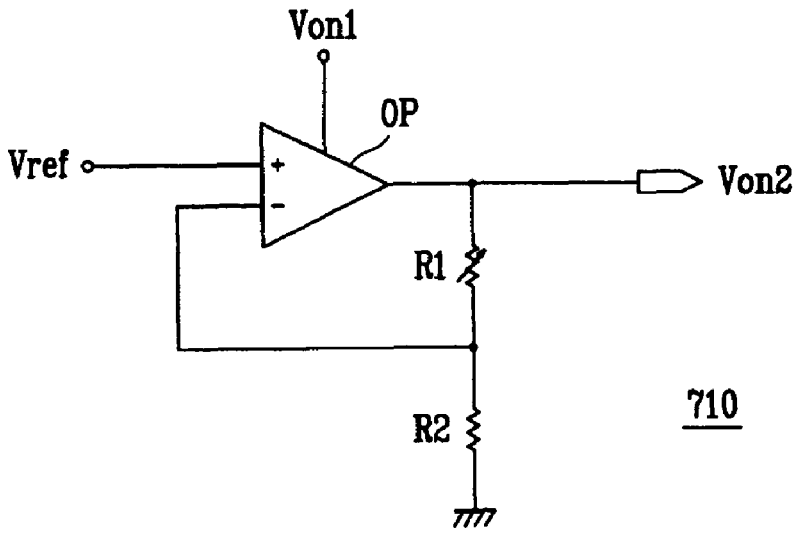
FIG. 3 is a circuit diagram of the voltage generator illustrated in FIG. 1.
Figure 4:
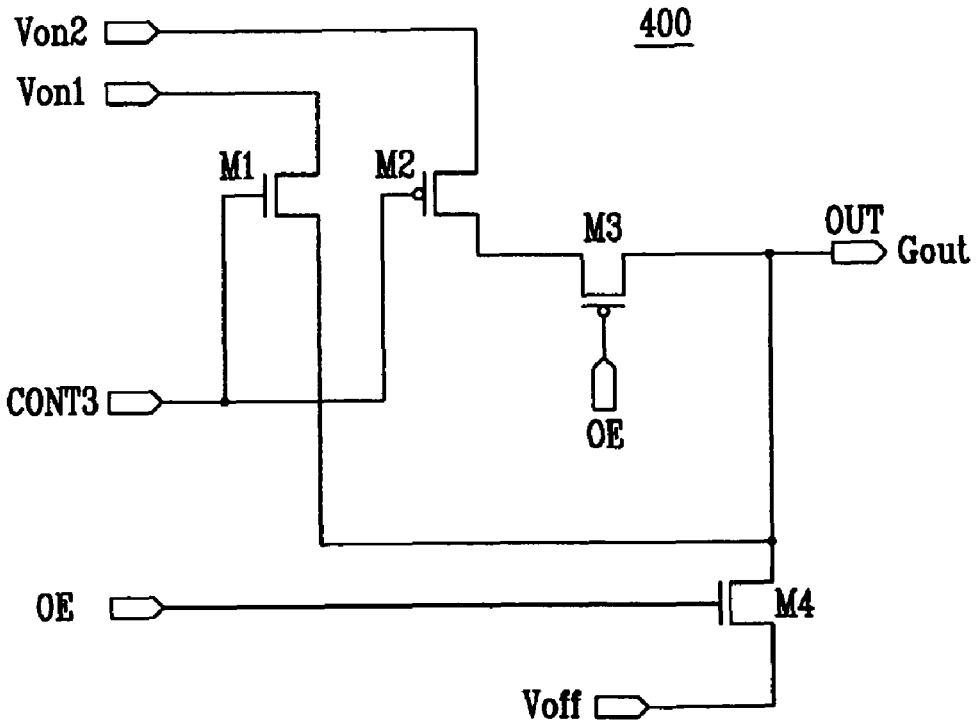
FIG. 4 is a circuit diagram of the gate driver illustrated in FIG. 1.

Referring to FIGS. 3 to 5, the driving apparatus of the liquid crystal display according to an exemplary embodiment of the present invention is illustrated in detail. FIG. 3 is an exemplary circuit diagram of the voltage generator illustrated in FIG. 1, FIG. 4 is an exemplary circuit diagram of the gate driver illustrated in FIG. 1, and FIG. 5 is a signal waveform diagram of the gate driver illustrated in FIG. 4.

Referring to FIG. 3, the voltage generator 710 includes an operational amplifier OP having a non-inversion terminal (+) connected to reference voltage Vref and an inversion terminal (−) connected to the mid-point of serially connected resistors R1 and R2. Resistor R1 is variable having its upper end connected to the output of amplifier OP and resistor R2 has its lower end connected to ground. A bias voltage is connected to the gate-on voltage Von1.

As so connected, operational amplifier OP is substantially a non-inversion amplifier that generates gate-on voltage Von2. The amplitude of the gate-on voltage Von2 is controlled by the variable resistor R1. The variable resistor R1 may be a passive element or a digital variable resistor DVR that is controllable by software. The size of the gate-on voltage Von2 is within the range of the bias voltage Von1, and thus cannot be greater than the size of the gate-on voltage Von1.

Referring to FIG. 4, gate driver 400 according to an exemplary embodiment of the present invention includes a plurality of transistors M1-M4. Transistors M1 and M4 are N-type transistors, and the transistors M2 and M3 are P-type transistors. Transistors M1-M4 may be MOS transistors or bipolar junction transistors.

The control terminals of the transistors M1 and M2 are connected to a switching control signal CONT3. The input and output terminals of the transistor M1 are connected to the gate-on voltage Von1 and an output terminal OUT, respectively. The input terminal of the transistor M2 is connected to the gate-on voltage Von2.

The control terminals of the transistors M3 and M4 are connected to an output enable signal OE. The input and output terminals of the transistor M3 are connected to the input terminal of the transistor M2 and the output end OUT, respectively. The input and output terminals of the transistor M4 are connected to the gate-off voltage Voff and the output end OUT, respectively.

Referring to the timing diagram illustrated in FIG. 5, the operation of the gate driver 400 is illustrated. As shown in FIG. 5, a gate clock signal CPV has a period of 2H, and a half period thereof is 1H.

As described above, the amplitude of gate-on voltage Von2 is sufficient to turn on the switching element Q, even though it is less than the amplitude of the gate-on voltage Von1. Gate-on voltage Von2 has a value greater than a sum of the voltage between the gate drains of the switching element Q, that is, a threshold voltage, and the maximum value of the data voltage applied to the input terminal. For example, the threshold voltage of the switching element Q is about 0.7V, and the data voltage is in a range of 0V to 10V. Thus, gate-on voltage Von2 has a value greater than 10.7V.

When the switching control signal CONT3 is high and the output enable signal OE is low, N-type transistor M1 is turned on and P-type transistor M2 is off. As a result, transistor M1 applies gate-on voltage Von1 to terminal OUT. Since the output enable signal OE is low, transistor M3 is turned on, and P-type transistor M2 remains off. Next, when the switching control signal CONT3 becomes low and the output enable signal OE is still low, transistor M1 is turned off and transistor M2 is turned on. Through the turned on transistors M2 and M3, the gate-on voltage Von2 is transferred to the terminal OUT.

When the output enable signal OE becomes high, transistor M3 is turned off but transistor M4 is turned on, and the gate-off voltage Voff is output to terminal OUT. As shown in FIG. 5, a gate output Gout(1)-Gout(n) having a step shape is generated. Thus, by using the output enable signal OE, the output timing of the gate-on voltage Von2 is controlled.

The generated gate output Gout(1)-Gout(n) passes through a demultiplexer (not shown) connected to the gate driver 400, and is sequentially applied to each of the gate lines $G_1$-$G_n$.

As shown in FIG. 5, the duration of the output times t1 and t2 of gate-on voltages Von1 and Von2 are advantageously equal, but may be different.

As described above, the kickback voltage is in proportion to the difference between the gate-on voltage and the gate-off voltage, and particularly the area of the quadrangle composed of the gate-on voltage and the gate-off voltage. Thus, the gate signal Gout(1)-Gout(n) having a step shape has a reduced area, thereby reducing the kickback voltage. The reduced kickback voltage reduces the change of the pixel voltage applied to a pixel PX, thereby preventing flicker.

According to an exemplary embodiment of the present invention, a driving apparatus includes the second voltage generator 710 for generating the gate-on voltage Von2 and the gate driver 400 having a plurality of transistors M1-M4 to generate the gate output Gout(1)-Gout(n) having a step shape, and thus a kickback voltage is reduced and flicker is prevented.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A driving apparatus for a display device having a plurality of pixels each having a switching element, comprising:

a gate line connected to the switching element;

a gate driver to apply first to third voltages to the gate line through an output end;

a first voltage generator to generate the first and third voltages; and a second voltage generator to generate the second voltage;

a first transistor comprising an input terminal configured to receive the first voltage, and an output terminal connected to the output end of the gate driver;

a second transistor comprising an input terminal configured to receive the second voltage, and an output terminal;

a third transistor comprising an input terminal connected to the output terminal of the second transistor, and an output terminal connected to the output end of the gate driver;

a fourth transistor comprising an input terminal configured to receive the first voltage, and an output terminal connected to the output end of the gate driver, wherein the first and second voltages turn on the switching element, and the third voltage turns off the switching element, and the second voltage is less than the first voltage.

2. The apparatus of claim 1, further comprising a signal controller to generate first and second control signals and to control the gate driver.

3. The apparatus of claim 2, wherein the first and second transistors are configured to output the first and second voltages in response to the first control signal, respectively; and wherein the third and fourth transistors are configured to output the second and third voltages in response to the second control signal, respectively.

4. The apparatus of claim 3, wherein the first and fourth transistors are N-type transistors, and the second and third transistors are P-type transistors.

5. The apparatus of claim 1, wherein a time for applying the first voltage and a time for applying the second voltage are the same.

6. The apparatus of claim 1, wherein a time for applying the first voltage and a time for applying the second voltage are different.

7. The apparatus of claim 1, wherein the second voltage generator includes an operational amplifier having a non-inversion terminal connected to a predetermined reference voltage, and an inversion terminal connected to an output end and a ground voltage through first and second resistors, respectively.

8. The apparatus of claim 7, wherein the operational amplifier has a bias voltage as the first voltage.

9. The apparatus of claim 8, wherein the first resistor is a variable resistor.

10. The apparatus of claim 9, wherein the variable resistor is a digital variable resistor.

11. The device of claim 1, wherein an on-pulse of the first voltage and an on-pulse of the second voltage constitute a continuous stepwise shape.

12. A display device comprising:

a plurality of pixels, each having a switching element;

a gate line connected to the switching element, a gate driver to transfer first to third voltages to the gate line;

a first voltage generator to generate the first and third voltages;

a second voltage generator to generate the second voltage;

a signal controller to generate a plurality of control signals and to control the gate driver;

a first transistor comprising an input terminal configured to receive the first voltage, and an output terminal connected to the output end of the gate driver;

a second transistor comprising an input terminal configured to receive the second voltage, and an output terminal;

a third transistor comprising an input terminal connected to the output terminal of the second transistor, and an output terminal connected to the output end of the gate driver;

a fourth transistor comprising an input terminal configured to receive the first voltage, and an output terminal connected to the output end of the gate driver, wherein the first and second voltages turn on the switching element, and the third voltage turns off the switching element, and the second voltage is less than the first voltage.

13. The device of claim 12, wherein the first and second transistors are configured to output the first and second voltages in response to a first control signal among the control signals, respectively; and wherein the third and fourth transistors are configured to output the second and third voltages in response to a second control signal among the control signals, respectively.

14. The device of claim 13, wherein the first and fourth transistors are N-type transistors, and the second and third transistors are P-type transistors.

15. The device of claim 12, wherein a time for applying the first voltage and a time for applying the second voltage are the same.

16. The device of claim 12, wherein a time for applying the first voltage and a time for applying the second voltage are different.

17. The device of claim 12, wherein the second voltage generator includes an operational amplifier having a non-inversion terminal connected to a predetermined reference voltage, and an inversion terminal connected to an output end and a ground voltage through first and second resistors, respectively.

18. The device of claim 17, wherein the operational amplifier has a bias voltage as the first voltage.

19. The device of claim 18, wherein the first resistor is a variable resistor.

20. The device of claim 19, wherein the variable resistor is a digital variable resistor.

* * * * *